United States Patent [19]

Westhead

[11] Patent Number: 4,857,391

[45] Date of Patent: Aug. 15, 1989

[54] NON-WOVEN PAPER MACHINE DRYER FABRIC WITHOUT SLACK EDGES

[75] Inventor: William T. Westhead, Waycross, Ga.

[73] Assignee: Scapa Inc., Waycross, Ga.

[21] Appl. No.: 136,414

[22] Filed: Dec. 22, 1987

[51] Int. Cl.[4] ..... D03D 13/00

[52] U.S. Cl. ..... 428/222; 34/116; 162/348; 162/DIG. 1; 428/224

[58] Field of Search ..... 428/222, 224; 162/DIG. 1, 348; 34/116

[56] References Cited

U.S. PATENT DOCUMENTS

| | | | |
|---|---|---|---|
| 3,867,766 | 2/1975 | Wagner | 34/95 |
| 4,346,138 | 8/1982 | Lefferts | 428/222 |
| 4,423,543 | 1/1984 | Leuvelink | 29/433 |
| 4,481,079 | 11/1984 | Dawes | 162/348 |
| 4,488,347 | 12/1984 | Leuvelink | 29/433 |
| 4,490,925 | 1/1985 | Smith | 428/222 |
| 4,583,302 | 4/1986 | Smith | 428/222 |
| 4,654,122 | 3/1987 | Bachmann et al. | 428/222 |
| 4,675,229 | 6/1987 | Westheal | 428/222 |
| 4,676,369 | 6/1987 | Borel | 428/222 |
| 4,696,852 | 9/1987 | Lefferts | 428/222 |
| 4,719,139 | 1/1988 | Gauther | 428/222 |

OTHER PUBLICATIONS

"Guiding of Dryer Clothing", a pamphlet published by Scapa, Inc., Waycross, Ga.

*Primary Examiner*—James J. Bell

*Attorney, Agent, or Firm*—Fleit, Jacobson, Cohn, Price, Holman & Stern

[57] ABSTRACT

This invention relates generally to a dryer fabric belt used in the dryer section of a papermaking machine. The dryer fabric belt is subjected to tension forces in a machine direction by a stretch roll over which the belt travels, and is substantially free from tension forces in the cross-machine direction. The dryer fabric belt includes a plurality of hinge yarns, each extending in the machine direction continuously throughout the length of the dryer fabric. A plurality of spring coils are disposed in a common plane in a side by side relationship. Each of the coils extends in the machine direction. Adjacent coils of the spring coils are intermeshed and held together in intermeshing relationship by at least one of the hinge yarns.

9 Claims, 3 Drawing Sheets

NON-WOVEN PAPER MACHINE DRYER FABRIC WITHOUT SLACK EDGES

BACKGROUND OF THE INVENTION

1. Field of the Invention

The present invention relates to a dryer fabric for a papermaking machine, and particularly to a dryer fabric constructed so as to eliminate slack dryer belt edge portions thereby eliminating their effect on the moisture profile of the paper web passing through the dryer section of the papermaking machine, improve tail feeding and fabric guiding.

2. Description of Related Art

U.S. Pat. No. 3,867,766 disloses a typical papermaking machine dryer section. The dryer section of the papermaking machine of this type includes an upper and a lower array of heated, cylindrical rolls arranged and spaced in a staggered, parallel array. A paper web exits from a pressing section of the papermaking machine and enters the dryer section. The paper web is generally passed to and fro between the arrays of dryer rolls in a generally serpentine manner to ensure that both sides of the paper web contact the dryer rolls as may be seen in FIG. 1 of the above U.S. patent. As the paper web passes over a dryer roll, it is held in intimate heat transfer relation therewith by an endless dryer belt as should be apparent from FIG. 1.

U.S. Pat. No. 4,423,543 discloses one known type of dryer belt. This patent discloses a spiral fabric including spiral coils which are laid out in a cross-machine direction. Adjacent spirals are intermeshed with one another to define a hinge yarn receiving opening. The opening receives a hinge yarn, typically a synthetic monofilament, which is inserted into the hinge yarn receiving opening defined by the intermeshed spirals.

While such a known spiral fabric has many positive attributes as a dryer fabric, such as good cross-machine stability resulting in excellent resistance to bowing, availability in a wide range permeabilities, and a high degree of surface smoothness for good contact with a paper web, it has a notable disadvantage. The known spiral fabric is prone to slack edges at which the edges of the spiral fabric may fall away from the dryer cylinder against which it presses.

When a paper sheet is sandwiched between the hot dryer cylinder and the dryer fabric, the dryer fabric presses the paper sheet against the cylinder and holds the sheet in contact with the cylinder, thereby improving heat transfer to the paper sheet. If the edges of the dryer fabric do not press the paper sheet fully against the cylinder, different drying rates in the middle and on the edges of the paper sheet, resulting in non-uniform moisture profile across the sheet, may therefore be produced. In extreme cases this may cause reduced finished paper sheet width because the edge of the paper sheet may need to be trimmed excessively.

Also, when a paper machine starts, a tail, i.e., a narrow edge sheet of paper approximately six inches wide, is first fed through the machine. If the edges of the dryer fabric are slack, feeding of the tail can be difficult and start-up of the machine slowed.

Also, dryer fabrics with slack edges can be difficult to guide because the edge can dip under the guide paddle thereby rendering the guiding mechanism inoperative. In such extreme cases the fabric can then run off the machine and be wrecked beyond repair.

The instant invention is designed to eliminate slack edges in non-woven dryer fabrics to be used in dryer sections of papermaking machines.

SUMMARY OF THE INVENTION

It is a primary object of this invention to eliminate or substantially reduce the incidence of slack edges in non-woven dryer fabrics which are utilized in dryer sections of papermaking machines. This may be accomplished by the use of a dryer fabric belt which includes a plurality of hinge yarns, each of which extends in the machine direction continuously throughout the length of the dryer fabric. A plurality of spiral coils also extend in the machine direction. Adjacent coils of the spiral coils are intermeshed and held together in intermeshing relationship by at least one of the hinge yarns.

Through the use of such a dryer fabric, the problem of slack edges in non-woven dryer fabrics is eliminated. Because the hinge yarns and spiral coils are oriented in the machine direction of the dryer fabric, tension applied in the machine direction of the fabric during use of the dryer belt acts directly on each and every component in the fabric. The hinge yarns and spiral coils thus provide the dryer fabric with a substantially more uniform tension in the machine direction than was provided in the previous spiral type dryer fabrics.

DETAILED DESCRIPTION

Figure 1:
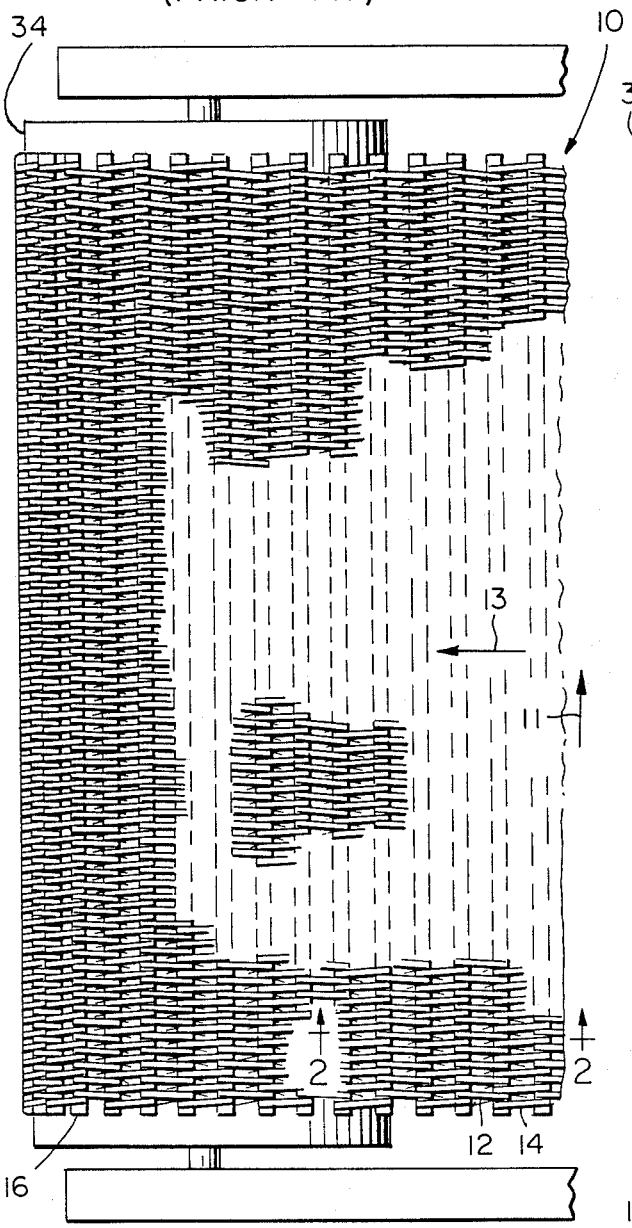
FIG. 1 (PRIOR ART)
FIG. 1 is a top plan view of a known spiral dryer fabric carried about a fabric roll.
Figure 2:
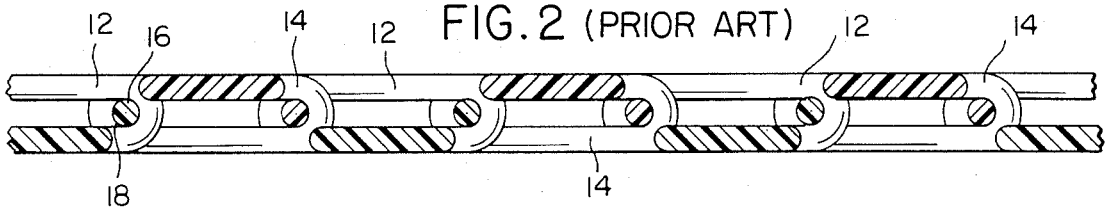
FIG. 2 (PRIOR ART)
FIG. 2 is a sectional view of the dryer fabric illustrated in FIG. 1 as seen along section line 2—2.

FIGS. 1 and 2 illustrate a portion of a known dryer fabric 10 which is similar to the dryer fabric disclosed by U.S. Pat. No. 4,423,543. The dryer fabric 10 basically comprises a plurality of spiral S-coils 12 made from circular or non-circular cross-section material joined together with a plurality of spiral Z-coils 14 likewise made from circular or non-circular cross-section material through the use of hinge yarns 16 of circular or non-circular cross section to create the fabric. The letters "S" and "Z" indicate the direction of twist of the spiral coils. A spiral coil has an S-twist if, when it is held vertically, the spirals or convolutions around its central axis slope in the same direction as the middle portion of the letter S, and Z-twist if the spirals slope in the same direction as the central portion of the letter Z. The cross-machine direction is indicated by arrow 11 and the machine direction by arrow 13 in FIGS. 1, 3 and 5.

The spiral coils 12 and 14 each consists of a length of spiral monofilament, i.e., a monofilament with the appearance of a spring coil. The monofilament is synthetic in nature and is typically made from polyester, although other materials, such as, polyamide, polyolefin, polyphenylene sulphide, polyetheretherketone, copolymers and the like, may be used.

In constructing a spiral fabric, a spiral coil (in this case S-coil 12) is first selected and laid out in what will eventually become the cross-machine direction indicated by arrow 11. Thus it can be appreciated that the width of the dryer fabric is thereby determined by the length of the coil. A second spiral coil (in this case Z-coil 14) is then intermeshed with the first spiral coil 12 to define a hinge yarn receiving opening 18. The opening 18 receives a hinge yarn 16 which is typically a synthetic monofilament, and like the spiral coils, may be of polyester, polyamide, polyolefin, polyphenylene sulphide, polyetheretherketone, copolymers and the like. The cross-machine direction hinge yarns inserted into adjacent intermeshed spiral coils act as pivotal hinges between the adjacent coils.

The laying down of additional spiral coils in an alternating "S" coil and "Z" coil relationship with the subsequent insertion of hinge yarns in continued until a fabric of desired length is produced. The spiral coils are alternately S-twist and Z-twist coils so as to reduce torque in the fabric.

After the dryer fabric has been formed through the intermeshing of the S-twist and Z-twist coils and the insertion of the hinge yarns, the fabric is then subjected to heat treatment and controlled tensioning. The tension control is placed in what will become the machine direction of the known dryer fabric, indicated by an arrow 13 in FIG. 1.

Under tension, the spiral coils 12, 14, which were originally circular or elliptical in transverse section, flatten. At the same time, the controlled tensioning and resultant flattening of the spiral coils causes crimping to occur in the hinge yarns. The crimp resulting from the heat treatment is desirable to stabilize the fabric and to ensure good runability on the paper machine, i.e., to prevent distortion or stretching. The crimping also ensures that the hinge yarns do not move laterally so as to leave an opening on either edge of the fabric. Thus, upon completion of the heating and controlled tensioning operations, a fabric is created in which the hinge yarns all lie in a common plane. In like manner, the spiral coils are flattened and also lie in the same common plane of the fabric.

Figure 5:
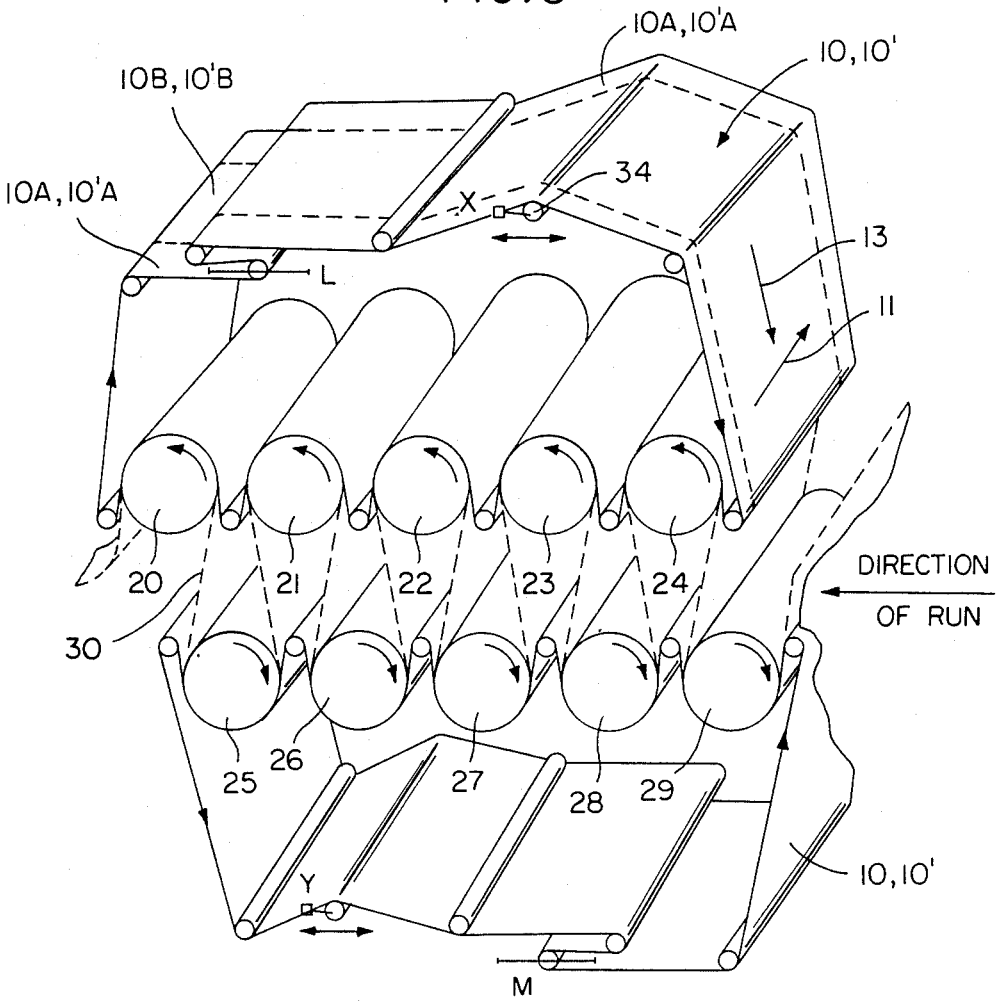
FIG. 5 is a simplified view of a dryer section of a papermaking machine in which both the known spiral dryer fabric and the non-woven dryer fabric of the instant invention are used.

Referring now to FIG. 5, there is illustrated a dryer section of a known papermaking machine, for example, the type shown in U.S. Pat. No. 3,867,766. The dryer section includes a first (upper) and a second (lower) array of horizontally disposed, generally cylindrical, hollow, steam heated dryer rolls. The upper array includes dryer rolls 20, 21, 22, 23 and 24, while the lower array includes dryer rolls 25, 26, 27, 28 and 29. A continuous web of paper 30 is received from the press section (not shown) of the machine and is passed in a serpentine manner seriatim about the dryer rolls. The paper web 30 is first passed under and about lower dryer roll 25, then over dryer roll 20, and then under dryer roll 26 and so forth until ultimately it is passed about a portion of the surface of each of the dryer rolls in the machine. As such, water and other fluids within the paper web 30 will be evaporated therefrom due to the web being held in contact with the dryer rolls.

The known dryer fabric described above can be provided for guiding the paper web 30 through the dryer section of the machine is illustrated in FIG. 5. Specifically, a first or upper dryer fabric 10, which has been made endless either by being woven as such or by being joined, is arranged to press and maintain the paper web 30 in intimate heat transfer relationship with the upper array of dryer rolls, by pressing the paper web 30 against the surfaces of the heated dryer rolls 20, 21, 22, 23 and 24 to remove water and/or other fluids therefrom.

Rolls are provided on the upper section of the machine and together with the upper dryer cylinders define the path of travel of the upper dryer fabric 10. A guide roll 34 is also present in the runto maintain the fabric 10 on the machine. Each roll has a longitudinal axis about which the roll rotates extending in cross-machine direction 11, while one end of guide roll 34 can be moved horizontally about an opposite fixed end to give a guiding effect to fabric 10.

In a normal fabric run there is one guide roll 34. All the machine rolls and dryer cylinders within the run define the path of travel of the dryer fabric. The guide roll keeps the fabric running straight on the machine by the following means.

One end of guide roll 34 is fixed while the other end can move horizontally. In the area of the guide roll 34 of the top fabric run section is a paddle x in contact with the edge of the fabric and connected to the guide roll 34. If the fabric moves away from the paddle x, the paddle follows and in so doing causes the moveable end of the guide roll to move to the left in FIG. 5. This means that the right hand side of the fabric contacts the guide roll 34 before the left hand side. The felt will travel to the side of the roll it touches first and hence the fabric will travel to the right, or in other words move back against the paddle. Conversely if the fabric moves towards the paddle (i.e. out from the drawing) the guide roll will move to the right causing the fabric to move back (i.e., into the drawing). It should be understood that guide roll 34 of the bottom fabric run section includes a paddle y and operates in a simlar fashion.

The second or lower dryer fabric 10 is associated with the lower array of dryer rolls for guiding the continuous paper web 30 through the machine. As with the upper dryer fabric, the lower dryer fabric maintains the paper web 30 in heat transfer relation with the dryer rolls, in this instance the lower array of dryer rolls. Fabric rolls are also provided on the lower section of the machine and together with the lower array of dryer cylinders define the path of travel of the second dryer fabric 10. Tension is maintained on the dryer fabric in machine direction 13 to ensure that the paper web 30 is maintained in good heat transfer relationship with the upper dryer rolls. Tension is applied to the upper dryer fabric by a stretch roll. Again referring to FIG. 5, the stretch roll for the top fabric run section is marked L.

The stretch roll axis of stretch roll L slides in a rack and can move horizontally as shown by the arrows. Tension is applied to the fabric by loading the stretch roll by means of pneumatics or a weight/pulley arrangement. The load on the stretch roll is thereby kept constant and hence the tension on the fabric is kept constant. Should the fabric shrink in use the stretch roll moves back (i.e. to the left in the case of stretch roll L) to accommodate a shorter fabric at the same tension. Similarly if the fabric stretches the stretch roll moves out (i.e. to the right in the case of stretch roll L) to maintain the tension.

It should be understood that the bottom fabric stretch roll marked M behaves in a similar manner.

As the paper web 30 travels through the dryer section, water is removed therefrom due to the web being maintained in intimate heat transfer relationship with the dryer cylinders, in this instance by being held in physical contact therewith.

In use, however, it has been found that the known dryer fabric of FIGS. 1 and 2 has a potential disadvantage. It is desirable that each dryer fabric 10 exert an uniform pressure on paper web 30 and on each dryer cylinder within the defined path of travel of the dryer fabric (cylinders 20, 21, 22, 23 and 24 for the top fabric and cylinders 25, 26, 27, 28 and 29 for the bottom fabric) all the way across the width of the paper web. However, when the known dryer fabric illustrated in FIGS. 1 and 2 is used in a dryer section similar to that shown in FIG. 5, it has been found that the edge portions (indicated at 10A) of the dryer fabric 10 tend to become slack and droop relative to the middle portion (indicated at 10B).

Referring again to FIG. 1, it can be seen that the spiral S-coils 12 and Z-coils 14 of the known dryer fabric 10 run in the cross-machine direction 11. Hinge pins 16 also extend in the cross-machine direction. The spiral coils 12 and 14 are very flexible in the cross-machine direction. Consequently, the known dryer fabric 10 derives much of its rigidity in the cross-machine direction from the hinge pins 16.

As the dryer fabric 10 ages, hinge pins 16 can fatigue. As the hinge pins fatigue, their rigidity decreases. This allows the dryer fabric 10 to become more flexible in the cross-machine direction. Edge portions 10A then tend to become slack. Moreover, in use, edge portions 10A of dryer fabric 10 may become laden with grease and oil. Due to the tendency of the edge portions 10A to droop and cause the hinge pins 16 to bend, the added weight of such grease and oil makes it even more likely that hinge pins 16 will fatigue at edge portions 10A of the dryer fabric.

Since they are slack, edge portions 10A of the dryer fabric tend not to force paper web 30 against dryer cylinders within the defined path of travel with as much pressure as does central portion 10B of the dryer fabric. The edge portions of paper web 30 may then be allowed to separate from the dryer cylinders and consequently dry more slowly than the remainder of the paper web. A non-uniform moisture profile across paper web 30 may thus be caused, and due to such a non-uniform moisture profile, a greater amount of the edge portions of the paper web 30 may have to be trimmed off, resulting in a reduced paper web width and in substantial waste of paper web material.

An additional problem may arise when the known dryer fabric of FIGS. 1 and 2 is used. When a paper machine starts up, a tail, i.e., a narrow edge sheet of paper of about 6 inches wide, is first fed through the machine. For good tail feeding through the dryer section, the machine crew rely on the machine carrier ropes and the dryer fabrics. Again, if the dryer fabric edges are slack or droop, the fabric will not control and guide the tail through the paper machine thus making tail feeding difficult and slowing machine start-up.

As can be seen in FIG. 5, the fabric edge runs against a paddle x or y which contacts and follows this edge. This paddle in turn controls the movement of the guide roll. If the fabric edge is slack or droops, the paddle has difficulty following the edge and guiding therefore becomes a problem. In the worst case, the edge of the fabric droops so much it goes below the paddle in which case guide roll control and hence fabric guiding is lost and the fabric will often run off the paper machine.

It is possible to reduce the effect of slack dryer belt edge portions on the paper web by applying tension to the dryer fabric in the machine direction 13. However, a relatively high tension is required in order to satisfactorily eliminate slack dryer belt edge portions in the known dryer fabric 10; since there are no yarns in the dryer fabric 10 which extend in the machine direction 13, the application of tension to fabric 10 in machine direction 13 does not readily cause slack edge portions 10A of the dryer fabric to press more tightly against dryer cylinders within the defined path of travel. Also many smaller and older paper machines have small rolls and bearings and are unable to apply the high tensions required by the known dryer fabric 10 as these will cause roll distortion and/or bearing damage.

Figure 3:
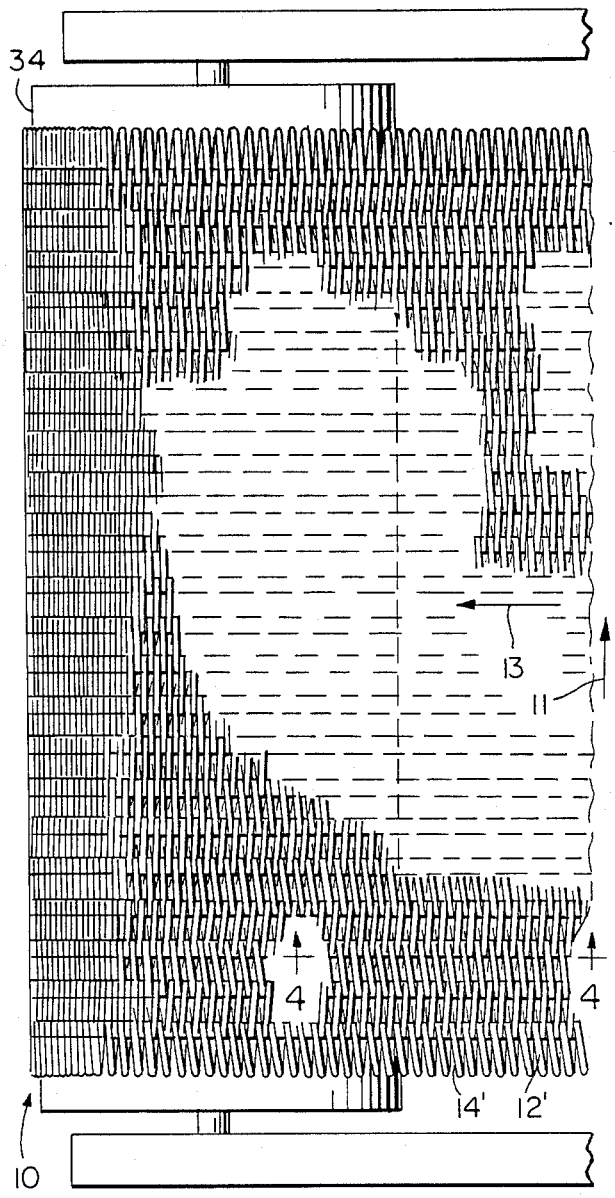
FIG. 3 is a top plan view of a non-woven dryer fabric in accordance with the instant invention and carried about a fabric roll.
Figure 4:
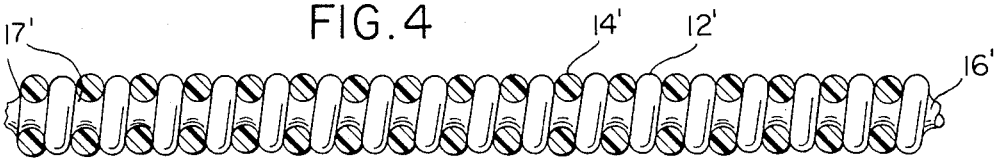
FIG. 4 is a sectional view of the dryer fabric illustrated in FIG. 3 as seen along section line 4—4.

FIGS. 3 and 4 of the drawings illustrate the dryer fabric construction which forms the basis of this invention. As will become apparent, it is possible to substantially eliminate slack or droop in edge portions of the dryer fabric of FIGS. 3 and 4 by application of much smaller increments of tension to the dryer fabric than has been heretofore necessary.

A dryer fabric 10' is illustrated in FIGS. 3 and 4. Dryer fabric 10' is formed from a plurality of spiral S-coils 12' joined together with a plurality of spiral Z-coils 14' through the use of hinge yarns 16'. S-coils 12', Z-coils 14' and hinge yarns 16' are joined together in a manner substantially similar to that in which previously-described coils 12 and 14 and hinge yarns 16 are joined. That is, hinge yarns 16' are received within a hinge yarn receiving opening formed by the intermeshed S and Z-coils 12' and 14'.

As FIGS. 3 and 4 illustrate, spiral coils 12' and 14' each form a spiral about a central axis which extends in machine direction 13. Hinge yarns 16' of the instant invention also extend in the machine direction 13 rather than in the cross-machine direction 11. It should therefore be apparent that hinge yarns 16' extend longitudinally of the dryer fabric of the instant invention in machine direction 13 rather than in the conventional manner across the dryer fabric in cross-machine direction 11. Consequently, if tension is applied along machine direction 13 of dryer belt 10', the tensile force acts directly along the respective longitudinal axes of hinge yarns 16' and throughout the entire length of dryer fabric 10'. Hinge yarns 16' provide dryer belt 10' with a means whereby tension applied to the fabric in the machine direction during use acts directly on each and every component in the fabric. The edge portions of dryer fabric 10' are therefore much more likely to react under such tension and thereby keep the edge portions 10'A of the dryer fabric 10' pressed tightly against the dryer cylinders of the papermaking machine by applying only small increments of tension to the dryer fabric 10' in the machine direction 13.

In order to be used in the papermaking machine dryer section illustrated in FIG. 5, it is clear that dryer fabric 10' must be formed into an endless belt-shaped loop. Dryer fabric 10' can be formed into such an endless belt-shaped loop by joining ends of the fabric together by a seam made in any suitable manner, examples of which are given below. As FIGS. 3 and 5 show, once the ends of fabric 10' have been joined, both hinge yarns 16' and the central axes about which coils 12' and 14' are spiraled extend in the machine direction circumferentially about the loop formed by the fabric.

Ends of the dryer fabric can be joined by being treated with an adhesive and then by sewing either a metallic or a non-metallic seam over the ends to connect them. Either type of seam is well known to those skilled in the art. However, such seams tend to be bulky and detract from the smooth surface of the spiral fabric itself.

Figure 6:
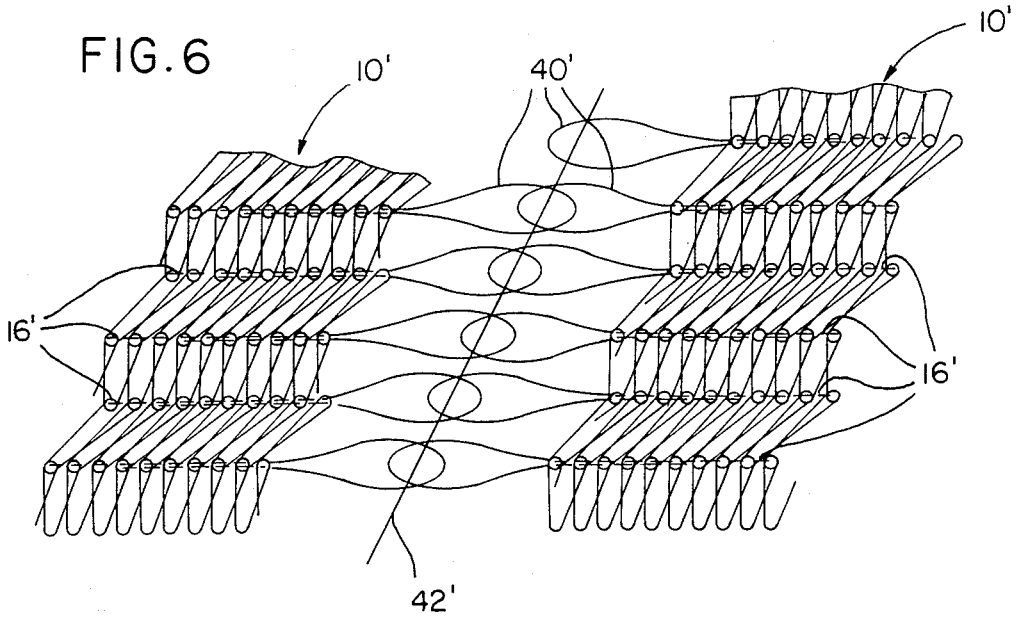
FIGS. 6 to 8 are schematic illustrations of a seam used to join together adjacent ends of the non-woven dryer fabric of the instant invention.
Figure 7:
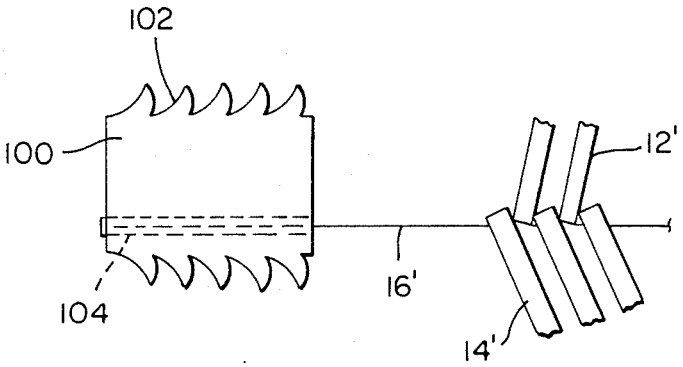
Figure 8:
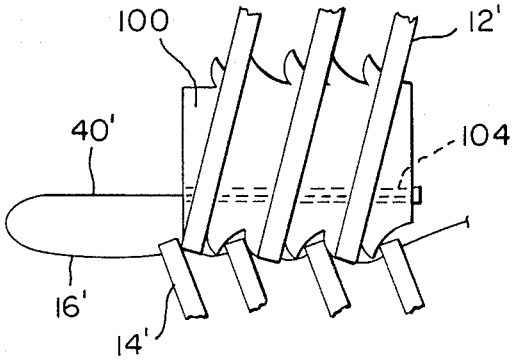

It should be clear from the foregoing that each of the hinge yarns 16' extends continuously throughout the length of dryer fabric 10'. Therefore an alternative seam, as illustrated by way of example in FIG. 6, uses the ends of the hinge yarns 16' themselves to form loops 40' by being bent around a suitable forming cable. The ends then can be connected together by plugging each end of each hinge yarn back into holes in the body of the fabric 10' formed by coils 12' and 14' in the manner illustrated in FIGS. 7 and 8. A block 100 has serrated type edges 102 allowing it to be easily inserted in adjacent spiral coils, but hard to pull out against the serrations. The hinge yarn 16' passes through a pre-formed hole 104 in the block 100 and is held there by melting and/or adhesive. The block is then inserted in the adjacent spiral coils 12'. The hole 104 is offset to ensure the loop is naturally as vertical to the surface plane of the fabric as possible. Further heat treatment will then ensure it is vertical. The loops can then be joined by a suitable pintle 42' after the forming cable has been removed from the formed loops. Such seams are in line with the planar surfaces of the fabric 10' and therefore do not detract from the overall smoothness of the planar fabric surfaces.

Another alternative is to use a synthetic pre-formed series of loops which can be securely attached to the hinge yarns 16' and then plugged into holes formed by the spiral coils 12' and 14' at each end of the fabric 10'.

Figure 9:
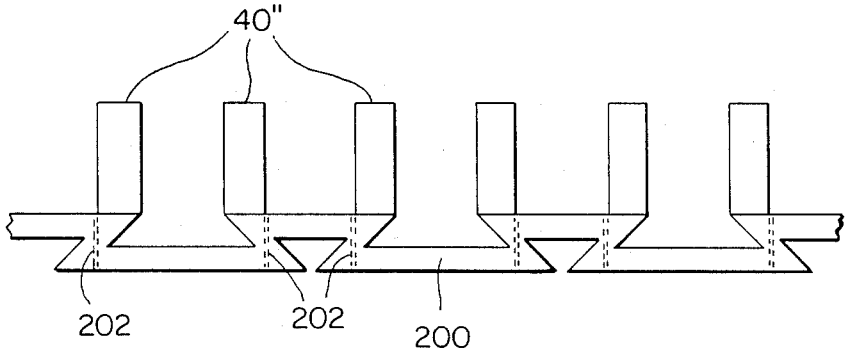
FIG. 9 is an illustration of another type of such a seam.

Referring to FIG. 9, a seam piece using such a pre-formed series of loops 40'' is illustrated. Part 200 of the pre-formed series of loops is compressible so it will fit in the ends of the spiral coils 12 and 14. Once in the coils, it can expand thereby resisting pull out from the spiral coils. Loops 40'' of two adjacent seam pieces can be joined by a suitable pintle in a manner similar to loops 40' of FIG. 6.

The hinge yarns 16' pass through holes 202 and are secured to the seam piece by means of melting and/or adhesive. This will also help to ensure the seam piece does not pull out under tension.

There are no doubt other techniques which can be used to form a joining seam at the ends of the dryer fabric.

As set forth previously, the dryer fabric 10' of the instant invention is constructed in a manner substantially similar to that in which the dryer fabric 10 of FIGS. 1 and 2 is constructed. Hinge yarns 16' are first received within a hinge yarn receiving opening formed by intermeshed S and Z-coils 12' and 14'. A sufficient number of S and Z-coils must be joined together with hinge yarns 16' to form a dryer fabric segment of sufficient length for the finished fabric requirement of the known paper machine. The fabric segment length in machine direction 13 generally ranges between 100 and 300 feet. Width of each segment can be of any convenient size for handling and is generally of width 10''-20''. Any number of segments can then be joined to give the required fabric is width of the known paper machine. Fabric width is generally between 100 and 400 inches.

After the hinge yarns 16' have been inserted within the hinge yarn receiving opening formed by intermeshed S and Z-coils 12' and 14', and the required number of segments joined the resultant dryer fabric segment is subjected to heat treatment and controlled tensioning by known tensioning devices in the cross-machine direction 11 and in the machine direction 13. Coils 12' and 14', which were originally circular or elliptical in transverse section, flatten under the controlled tensioning into the configuration of the dryer fabric 10' illustrated in FIGS. 3 and 4. Simultaneously, the controlled tensioning of the dryer fabric causes crimping 17' to occur in the hinge yarns 16'. Crimping 17' helps to stabilize and to prevent distortion or stretching of the fabric 10' as the fabric is subjected to tensile force during its use in the dryer section shown in FIG. 5. The crimping also assures that coils 12' and 14' will not move longitudinally relative to hinge yarns 16' as dryer fabric 10' is used. In experimental test runs, movement of the coils 12' and 14' on hinge yarns 16' did not occur, even after a prolonged test running of the dryer fabric of almost 60 days at a speed of 2000 feet per minute and a tension of over 20 pounds per linear inch.

After heat treatment and controlled tensioning, the dryer fabric seamed using one of the seams described above, after which it is joined by means of the seam into an endless loop on the paper machine.

The foregoing is considered as illustrative only of the principles of the invention. Since numerous modifications and changes may occur to those skilled in the art, it is not desired to limit the invention to the exact construction and operation shown and described. Accordingly, there are suitable modifications and equivalents that fall within the scope of the invention.

I claim:

1. A dryer fabric comprising:

a plurality of hinge yarns, each of said hinge yarns extending in a machine direction continuously throughout the length of said dryer fabric and circumferentially about a loop formed by said dryer fabric;

a plurality of spiral coils disposed in a side by side relationship in a cross-machine direction substantially perpendicular to said machine direction, each of said coils forming a spiral about a central axis which extends in said machine direction circumferentially about said loop, adjacent coils of said spiral coils intermeshed and held together in intermeshing relationship by at least one of said hinge yarns.

2. A dryer fabric as defined in claim 1, wherein said loop formed by said dryer fabric includes a pair of opposed ends, loops at each of said opposed ends, ends of said hinge yarns themselves forming the loops at each of said opposed ends, and a pintle passing through the loops at each of said opposed ends to join said opposed ends together to form a seam.

3. A dryer fabric as defined in claim 1, wherein said loop formed by said dryer fabric includes a pair of opposed ends, a pre-formed series of loops attached to said hinge yarns at each of said opposed ends, and a pintle passing through the loops at each of said opposed ends to join said opposed ends together to form a seam.

4. A dryer fabric as defined by claim 2 wherein each of said hinge yarns is crimped.

5. A dryer fabric belt extending in a machine direction and a cross-machine direction, said dryer fabric belt subjected to tension forces in said machine direction and being substantially free from tension forces in said cross-machine direction, said dryer fabric belt including a plurality of hinge yarns, each of said hinge yarns extending in said machine direction continuously throughout the length of said dryer fabric belt circumferentially about an endless belt-shaped loop formed by the dryer fabric belt; and a plurality of spiral coils disposed in side by side relationship in a cross-machine direction substantially perpendicular to said machine direction, each of said coils forming a spiral about a central axis which extends in said machine direction circumferentially about said loop, adjacent coils of said spiral coils intermeshed and held together in intermeshing relationship by at least one of said hinge yarns.

6. A dryer fabric belt as defined by claim 5 wherein said dryer fabric belt has a pair of ends, and wherein said endless belt-shaped loop is formed by joining said ends together at a seam.

7. A dryer fabric belt as defined by claim 6 wherein each of said hinge yarns includes a pair of ends, and wherein said ends of said hinge yarns themselves form loops joined together by a pintle passing therethrough to form said seam.

8. A dryer fabric as defined by claim 7 wherein each of said hinge yarns is crimped.

9. For use in the dryer section of a papermaking machine having a plurality of rolls, each of said rolls having a longitudinal axis extending in a cross-machine direction and rotatable about said longitudinal axis, a dryer fabric belt for extending about said rolls and for moving in a machine direction about said rolls in response to rotation of the rolls about said longitudinal axes, said machine direction being substantially perpendicular to said cross-machine direction, one of said rolls for maintaining tension on said dryer fabric belt in said machine direction, said dryer fabric belt being substantially free from tension forces in said cross-machine direction, said dryer fabric belt including a plurality of hinge yarns, each of said hinge yarns extending in said machine direction continuously throughout the length of said dryer fabric belt and a plurality of spiral coils disposed in a common plane in a side by side relationship, each of said coils extending in said machine direction, adjacent coils of said spiral coils intermeshed and held together in intermeshing relationship by at least one of said hinge yarns.

* * * * *